US012503273B1

(12) United States Patent
Jacob et al.

(10) Patent No.: US 12,503,273 B1
(45) Date of Patent: Dec. 23, 2025

(54) MAGNETIC STRAW COVER

(71) Applicant: Brumate, Inc., Denver, CO (US)

(72) Inventors: Dylan M. Jacob, Denver, CO (US); Jennifer Serino, Denver, CO (US)

(73) Assignee: BruMate, Inc., Denver, CO (US)

( * ) Notice: Subject to any disclaimer, the term of this patent is extended or adjusted under 35 U.S.C. 154(b) by 0 days.

(21) Appl. No.: 19/299,155

(22) Filed: Aug. 13, 2025

Related U.S. Application Data

(63) Continuation of application No. 18/905,116, filed on Oct. 2, 2024.

(51) Int. Cl.
*B65D 41/16* (2006.01)
*A47G 21/18* (2006.01)

(52) U.S. Cl.
CPC ..... *B65D 41/16* (2013.01); *A47G 21/18* (2013.01); *B65D 2313/04* (2013.01)

(58) Field of Classification Search
CPC ..... A47G 21/18; A47G 19/2272; A47G 19/2266; A47G 2200/10; B65D 41/16; B65D 2313/04; A45F 3/16
USPC ..... 220/709, 705, 230, 771, 752; 215/229, 215/228, 388, 316
See application file for complete search history.

(56) References Cited

U.S. PATENT DOCUMENTS 2,672,257 A * 3/1954 Simmonds ..... B65D 55/16 220/230
3,172,561 A * 3/1965 Schwartz ..... A61J 9/00 215/11.1
4,441,640 A * 4/1984 Lottick ..... F25D 3/08 62/457.2
4,930,652 A * 6/1990 Murphy ..... B65D 77/283 215/388
5,249,702 A * 10/1993 Topp ..... A47G 19/2266 604/82
5,388,712 A * 2/1995 Brody ..... B65D 47/14 222/215
5,439,125 A * 8/1995 Bloch ..... A61J 9/00 215/11.1
7,080,916 B1 * 7/2006 Ferrin ..... A47G 21/182 220/705
2014/0061248 A1 * 3/2014 Hoskins ..... B65D 51/1644 222/215

(Continued)

FOREIGN PATENT DOCUMENTS

DE 102017106538 A1 * 9/2018 ..... A45F 3/16

OTHER PUBLICATIONS

Facebook : "Brumate VIP Facebook Group", Available at: <https://www.facebook.com/reel/350131494384856>, publicly disclosed on : Dec. 19, 2023.

*Primary Examiner* — Robert J Hicks
(74) *Attorney, Agent, or Firm* — Shook, Hardy & Bacon L.L.P.

(57) ABSTRACT

Removable straw cover securing mechanisms, beverage containers with removable straw cover securing mechanisms, and methods of manufacturing, testing, and using the same are provided herein, among things. The removable straw cover includes a magnetic or ferromagnetic component that can be mateably engaged with a corresponding magnetic or ferromagnetic element on a lid to securely secure the removable straw cover to the lid. This magnetic interaction forms a secure yet easily detachable bond, allowing for convenient use.

19 Claims, 4 Drawing Sheets

(56) References Cited

U.S. PATENT DOCUMENTS

| | | | | |
|---|---|---|---|---|
| 2014/0175098 | A1* | 6/2014 | Lane | A45F 3/18<br>220/212.5 |
| 2018/0362225 | A1* | 12/2018 | Davies | A45F 3/16 |
| 2020/0261938 | A1* | 8/2020 | Haden | B05B 15/62 |
| 2021/0394959 | A1* | 12/2021 | Nazarian | A47G 21/02 |

* cited by examiner

MAGNETIC STRAW COVER

CROSS REFERENCE TO RELATED APPLICATIONS

This application is a Continuation of U.S. patent application Ser. No. 18/905,116 filed Oct. 2, 2024, the entire contents of which are incorporated by reference herein in their entirety.

TECHNICAL FIELD

The field relates to travel beverage holders and other containers that can be sealed using a lid, specifically those equipped with integrated drinking straws or similar mechanisms that facilitate drinking directly from the containers.

BACKGROUND

Travel containers are often used to transport liquids. For example, travel beverage containers including those that are insulated, non-insulated, double-walled, or otherwise configured to hold a liquid are often used by consumers to transport their beverages. Travel beverage containers often have a lid for sealing an opening of the container, as well as a straw for drinking the liquid housed inside the container. In the current market, although there are various removable straw covers and covers designed to protect drinking straws from contamination, many lack effective mechanisms, making them cumbersome to use and requiring significant effort to attach or remove, which can be inconvenient for users on the go. The conventional covers attached to the straws can also obstruct the drinking process, requiring the user to maneuver around the removable straw cover, which can be inconvenient and uncomfortable. While removable straw covers are an improvement, they introduce a new problem: the risk of losing the removable straw cover when it is not in use. This is especially problematic during travel or outdoor activities where keeping track of small accessories can be difficult. Therefore, a securing mechanism for a removable straw cover for a drinking straw that can be easily implemented, easily used, and easily stored when not in use, is needed.

SUMMARY

This summary is intended to introduce a selection of concepts in a simplified form which are further described below in the detailed description section of this disclosure. This summary is not intended to identify key or essential features of the claimed subject matter, nor is it intended to be used as an aid in isolation to determine the scope of the claimed subject matter.

In brief, and at a high level, this disclosure describes, among other things, a securing mechanism for a removable straw cover for a drinking straw, a lid with a magnetic element that can be removably coupled to the removable straw cover, and methods of manufacturing the same, among other things.

In embodiments, a removable straw cover securing mechanism is provided. The removable straw cover securing mechanism can include separate elements that can be mateably engaged to thereby form a magnetic bond that substantially limits or inhibits the removable straw cover from getting lost when not in use. The removable straw cover securing mechanism can include a first magnetic element located on a removable straw cover and a second magnetic element located on a lid. The first magnetic element and the second magnetic element are configured to be releasably and/or reversibly coupled together to form a magnetic bond between the removable straw cover and the lid. In some embodiments, the first magnetic element is located about an inner surface of the removable straw cover, and the second magnetic element is located about the lid. In some embodiments, the removable straw cover can have a textured exterior for improved grip when inserting or removing the removable straw cover from the straw. In various embodiments, the removable straw cover can be sized differently to fit various straw dimensions. In some embodiments, the removable straw cover can be color-coded to correspond with different straws types and sizes. The aforementioned configurations for a removable straw cover securing mechanism can allow the removable straw cover to be easily secured to the lid.

In an embodiment, a removable straw cover for a drinking straw is provided. The removable straw cover is configured to couple to a top end of a drinking straw and is also configured to be removably coupled to a lid. The removable straw cover can include a body configured to fit snugly over an open end of the drinking straw, the body having a first end and a second end, wherein the first end includes an inner sealing surface adapted to engage with the outer surface of the drinking straw to create a fluid-tight seal by closely conforming to the shape of the straw. The removable straw cover can include a closure portion at the second end of the body adapted to fully cover the open end of the drinking straw, thereby preventing spillage of liquid from the drinking straw when not in use. The removable straw cover can include a magnetic element disposed within the body against an inside of the closure portion at the second end, the magnetic element being adapted to magnetically attach the removable straw cover to a magnetically attractive element disposed on or within a beverage container or a lid of the beverage container in which the drinking straw is used.

The removable straw cover, beverage container assembly, and other embodiments described herein can provide multiple advantages and improvements. For example, using the beverage container assembly and related assemblies described herein that include a lid securing mechanism can ensure that the removable straw cover remains securely affixed to the lid, minimizing the risk of detachment during use or transport. In some aspects, the use of magnets or magnetic substances (e.g., ferromagnetic elements) in the removable straw cover and lid allows for a strong yet easily reversible attachment, making the removable straw cover both secure and user-friendly. Users can effortlessly attach and remove the removable straw cover with minimal effort, enhancing convenience and encouraging regular use. In addition, the aspects described herein allow a removable straw cover securing mechanism to be implemented with limited excess components and greater simplicity and cost-efficiency, among other benefits.

BRIEF DESCRIPTION OF THE DRAWINGS

The embodiments described herein relate to removable straw cover securing mechanisms, container assemblies with removable straw cover securing mechanisms, e.g., such as beverage container assemblies and travel beverage containers, and methods of manufacturing and using the same are described in detail in connection with the attached drawing figures, which are incorporated by reference herein, and wherein.

DETAILED DESCRIPTION

Figure 1:
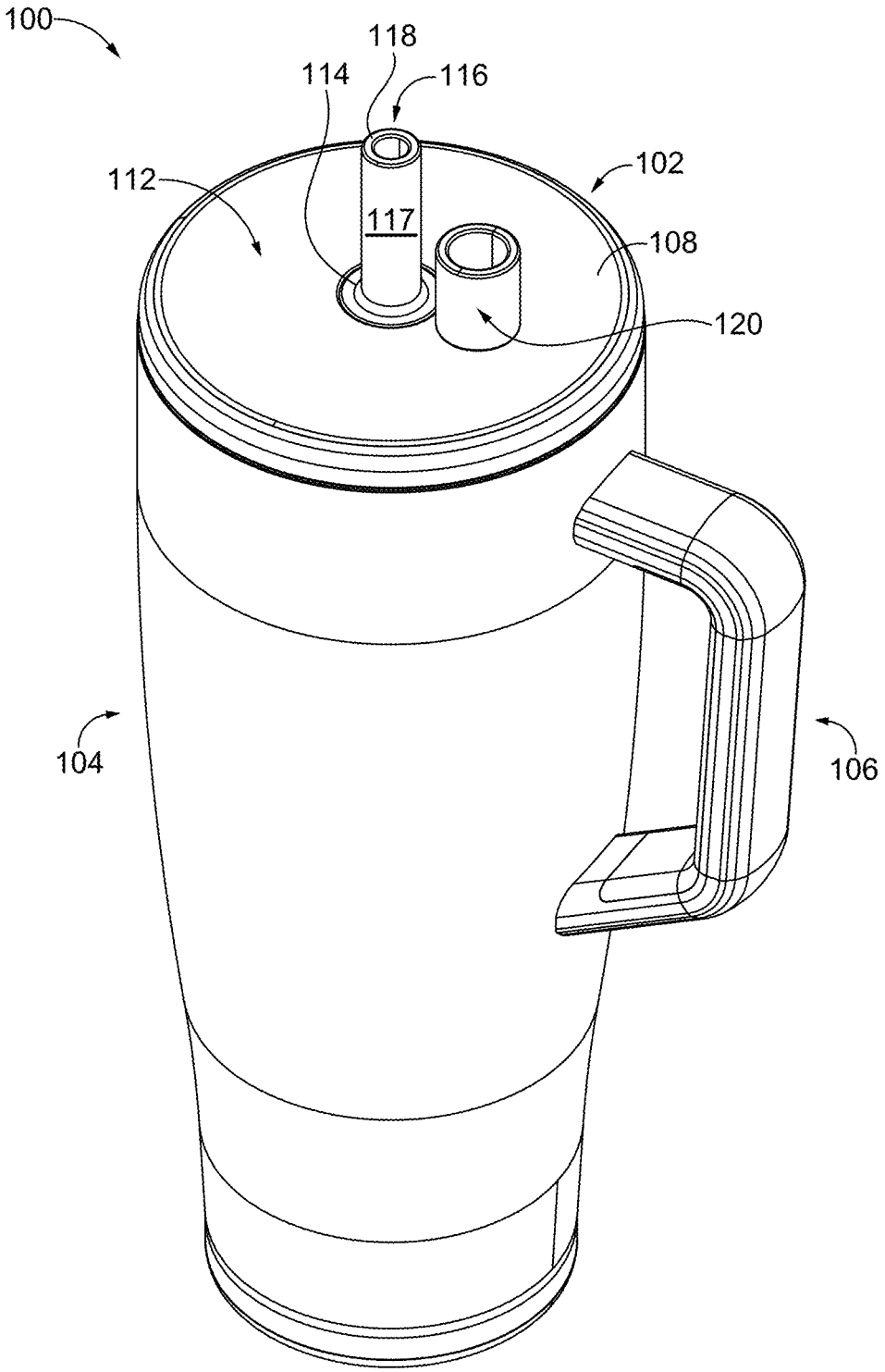
FIG. 1 depicts a perspective view of a beverage container assembly with a removable straw cover securing mechanism, in accordance with embodiments hereof.

This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar to those described in this disclosure, and in conjunction with other present or future technologies.

Various technical terms, acronyms, and shorthand notations are employed to describe, refer to, and/or aid the understanding of certain concepts pertaining to the present disclosure. Unless otherwise noted, said terms should be understood in the manner they would be used by one with ordinary skill in the art. The following is a list of definitions:

Magnetic Element:

A magnetic element refers to a material or object that produces a magnetic field, enabling it to attract or repel other magnetic materials. Commonly, these elements include permanent magnets, such as neodymium magnets, which can maintain their magnetic properties over time.

Ferromagnetic Element:

A ferromagnetic element is a material that does not inherently produce a magnetic field but can be magnetized and is strongly attracted to magnets. Examples include materials such as iron, steel, and nickel. These elements play a crucial role in creating a magnetic connection when paired with a magnet.

Magnetically Attracted Element:

A magnetically attracted element is any material that a magnetic element can attract. This includes neodymium magnetic elements, ferromagnetic elements, as well as other materials that respond to a magnetic field but do not produce a field of their own.

Magnet-to-Magnet Interaction:

In a magnet-to-magnet interaction, two magnets with opposite polarities are placed in proximity to each other. This creates a strong magnetic bond due to the alignment of their magnetic fields. This type of connection provides a firm attachment, typically stronger than a magnet-to-ferromagnet interaction.

Magnet-to-Ferromagnet Interaction:

A magnet-to-ferromagnet interaction occurs when a magnetic element is paired with a ferromagnetic material, such as steel. The magnetic element generates a magnetic field that attracts the ferromagnetic material. While this bond is strong, it is generally less powerful than a magnet-to-magnet connection because only one element produces a magnetic field.

The following is a list of magnetic element combinations between the removable straw cover and the lid to the cup, further discussed herein:

Magnetic Removable Straw Cover and Magnetic Lid:

In this configuration, both the removable straw cover and the lid contain permanent magnetic elements. The opposing polarities of the magnets create a strong magnetic bond, ensuring a secure connection between the removable straw cover and the lid. This combination offers the highest level of magnetic strength and stability, making it difficult for the removable straw cover to become detached accidentally.

Magnetic Removable Straw Cover and Ferromagnetic Lid:

In this configuration, the removable straw cover contains a permanent magnetic element, while the lid is made of or contains a ferromagnetic material. The magnetic field from the removable straw cover's magnet attracts the ferromagnetic lid, forming a strong, but slightly weaker bond compared to the magnet-to-magnet interaction. This configuration provides a balance of strength and flexibility.

Ferromagnetic Removable Straw Cover and Magnetic Lid:

In this configuration, the removable straw cover contains a ferromagnetic material, while the lid is made of or contains the permanent magnetic element. The magnetic element in the lid generates a field that attracts the ferromagnetic cover. While still a strong connection, the interaction is not as robust as when both elements are magnetic. This configuration allows for a secure yet easily detachable connection In general, disclosed herein are removable straw cover securing mechanisms; products, containers, and lids having removable straw cover securing mechanisms; and methods of manufacturing and using the same, among other things. The removable straw cover securing mechanisms described herein can be operated to releasably or reversibly couple a removable straw cover to a lid of a liquid-holding container, e.g., a travel beverage container. In some embodiments, the removable straw cover securing mechanism is used by placing the magnetic side of the removable straw cover onto a magnetic or ferromagnetic portion of the lid. In some embodiments, the removable straw cover can be magnetic and/or ferromagnetic. In some embodiments, the lid can include magnetic and/or ferromagnetic elements. In various embodiments, the removable straw cover and the straw can have a friction fit when in the "use" position (e.g., when the removable straw cover is coupled to the straw) thereby fitting snugly over the open end of the drinking straw and creating a fluid-tight seal. Detailed and non-limiting examples of the present subject matter are discussed below in connection with attached FIGS. 1-5.

Looking initially at FIG. 1, an exemplary beverage container assembly 100 is shown, in accordance with some embodiments of the present disclosure. The beverage container assembly 100 includes a lid 102 and a cup 104 that are configured to be releasably and/or reversibly coupled together to form a seal. The beverage container assembly 100 may optionally further include a handle 106 to facilitate carrying the beverage container assembly 100. As further shown in FIG. 1, in embodiments, the lid 102 comprises a top surface 108 adapted to cover an opening of beverage container assembly 100. The lid 102 also comprises a magnetic element 112 and a straw mechanism 114 with an opening through which a user is able to insert a straw 116 to drink fluids stored within the beverage container assembly 100. The straw 116 comprises an outer surface 117 with an open end 118, the open end 118 referring to the top portion of the straw 116 that remains exposed for the user to drink from. This open end 118 allows the user to access the liquid within the beverage container assembly 100 by creating a pathway for the fluid to travel when suction is applied. The beverage container assembly 100 also includes a removable straw cover 120 that is configured to be releasably and/or reversibly coupled to the magnetic element 112 on the lid 102, thereby allowing the removable straw cover 120 to be stowed on the lid 102 when the removable straw cover 120 is not in use. The cup 104 of the beverage container assembly 100 may optionally include a handle 106 located on a sidewall to facilitate transport of the beverage container assembly 100 by a user. In FIG. 1, element 104 is referred to as a cup. This term is intended to be broadly encompassing and to include different types of enclosures with a base, a sidewall, and an opening such that the enclosure is suitable for holding liquids, and is not intended to be limited to a particular type, size, shape, or class of drink container. In some embodiments, the beverage container assembly 100 shown in FIG. 1 could be similarly integrated into another type of container, e.g., such as a canister-type container.

Figure 2:
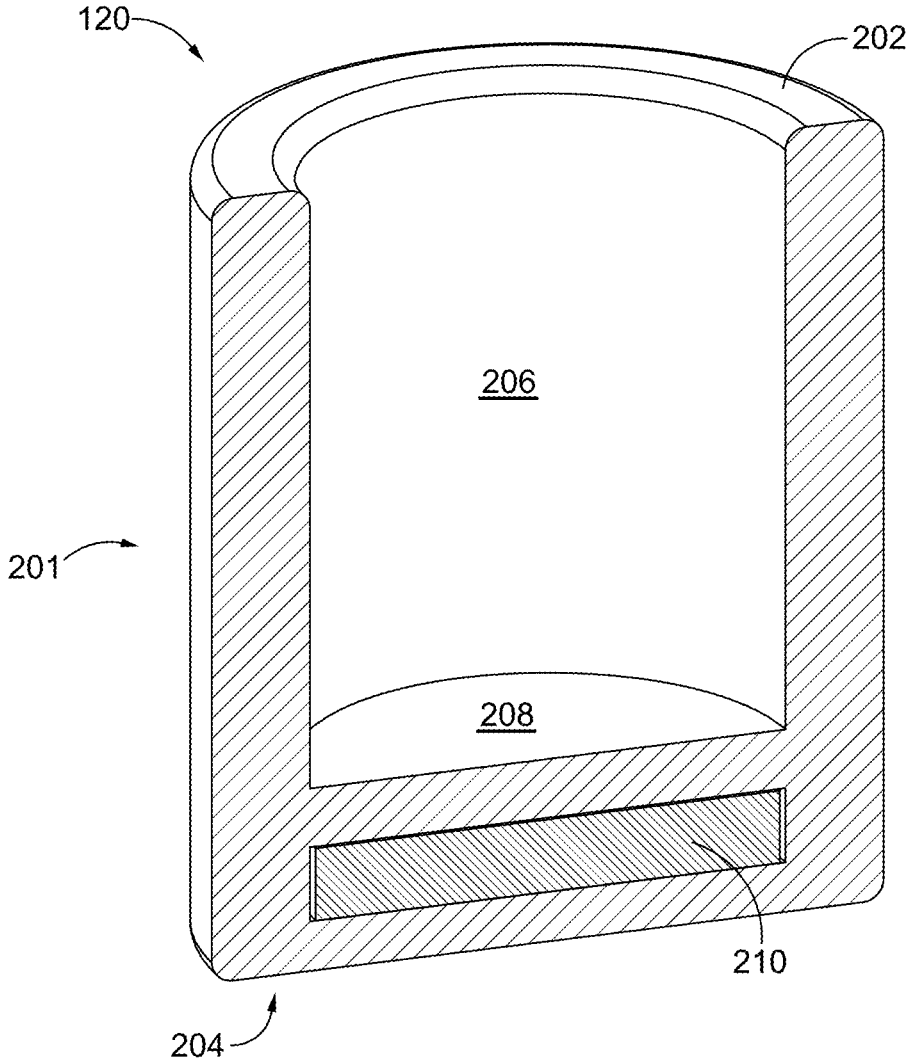
FIG. 2 depicts a cross-sectional view of the removable straw cover shown in FIG. 1, in accordance with embodiments hereof.

FIG. 2 depicts a cross-sectional view of the removable straw cover 120 in accordance with some embodiments described herein. The removable straw cover 120 comprises a body 201 configured to fit snugly over the open end 118 of a drinking straw (e.g., straw 116). The body 201 has a first end 202 (e.g., a rim) and a second end 204 (e.g., a base), wherein between the first end 202 and the second end 204, there is an inner sealing surface 206 adapted to engage with the outer surface 117 of the drinking straw 116 to create a fluid tight seal. The removable straw cover 120 also comprises a closure portion 208 at the second end 204 of the body 201 adapted to fully cover the open end 118 of the drinking straw 116 when the straw 116 is not in use. The removable straw cover 120 comprises a magnetic element 210 disposed within the body 201 against an inside of the closure portion at the second end 204, the magnetic element 210 being adapted to magnetically attach the removable straw cover 120 to a magnetically attractive element (e.g., magnetic element 112) disposed on or within a beverage container (e.g., cup 104) or the lid 102 of the beverage container assembly 100 in which the drinking straw 116 is used.

The removable straw cover 120 is shown with a puck-shaped magnet 210 placed at the second end 204 and encased within a protective enclosure integrated into the closure portion 208 to prevent contact and protect the magnet 210 from corrosion. In other embodiments, the magnet can take various shapes (e.g., rectangle, square, oval, ring, bar, circle, disc, spherical, cylindrical). As discussed above in the definitions section, in some embodiments, the magnetic element 210 comprises a neodymium magnet that can provide a strong magnetic attachment to the magnetically attractive element 112 on or within the beverage container assembly 100 or lid 102 In other embodiments, the entire removable straw cover 120 (e.g., the body 201) can comprise a magnetic material, providing a uniform magnetic field across the surface, as well as offering the user the option of placing the removable straw cover 120 with the second end 204 coupled to the lid 102 or, alternatively, with the first end 202 coupled to the lid 102. In other embodiments, only the first end 202 of the removable straw cover 120 can comprise the magnetic material. In alternative embodiments, the magnetic element 210 in the removable straw cover 120 can instead be a ferromagnetic material (e.g., steel, iron, nickel) that can couple to a magnetic material of the lid 102 to achieve the desired coupling.

In some embodiments, the magnet 210 may be visible (e.g., positioned on the outer layer of the first end 202 and/or the second end 204), adding an aesthetic element to the removable straw cover 120, while in others, it may be hidden within the removable straw cover's 120 flexible, resilient material (e.g., silicone, thermoplastic, rubber, and the like). The magnetic material, whether embedded within or exposed on the surface of the removable straw cover 120, can be coated with a protective layer to prevent corrosion, ensuring long-lasting performance. The removable straw cover 120 can comprise a flexible, resilient material that allows repeated attachment and detachment from the straw 116 without loss of sealing integrity. The inner sealing surface 206 can include one or more circumferential ribs or grooves adapted to enhance the fluid-tight seal between the straw cover 120 and the drinking straw 116. The straw cover 120 can further comprise a grip portion integrated into the body 201 to facilitate manual attachment and detachment of the straw cover 120 from the drinking straw 116. In embodiments, the grip portion can comprise one or more raised ridges, textured surfaces, or tabs to improve a user's grip during attachment and detachment. This flexibility in material and design allows the removable straw cover to be customized for various applications and user preferences.

Figure 3:
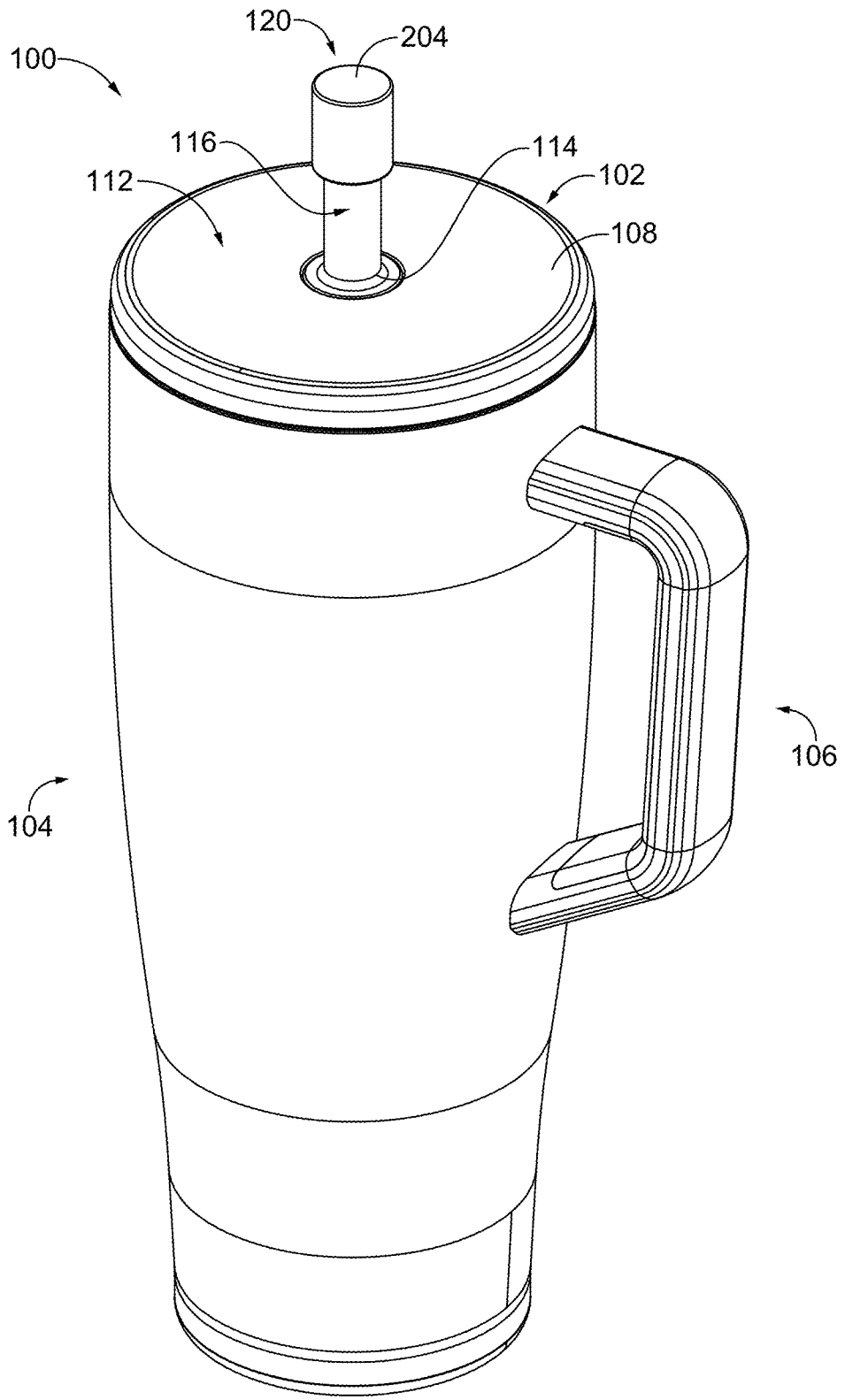
FIG. 3 depicts a perspective view of a removable straw cover securing mechanism in an uncoupled configuration when the straw is not in use, in accordance with embodiments hereof.

Looking now at FIG. 3, a perspective view of beverage container assembly 100 is shown, in accordance with an embodiment of the present disclosure. FIG. 3, in particular, shows one configuration of the removable straw cover 120 in a "use" configuration. The removable straw cover 120 is in the "use" configuration when it is actively covering the straw 116. In other words, the removable straw cover 120 is attached or closed over the open end 118 of the straw 116 to prevent contaminants (e.g., dust, dirt, germs, etc.) from coming into contact with the open end 118 of the drinking straw 116. In this embodiment, the removable straw cover 120 can remain securely in place with a friction fit to create a fluid-tight seal and prevent spillage of liquid from the straw 116 while the straw 116 is not being used for drinking. When the user is ready to use the straw 116 for drinking, the user can remove the removable straw cover 120 and place it on the magnetic element 112 on the lid 102 to access the open end 118 of the straw 116, as shown in FIG. 1.

Figure 4:
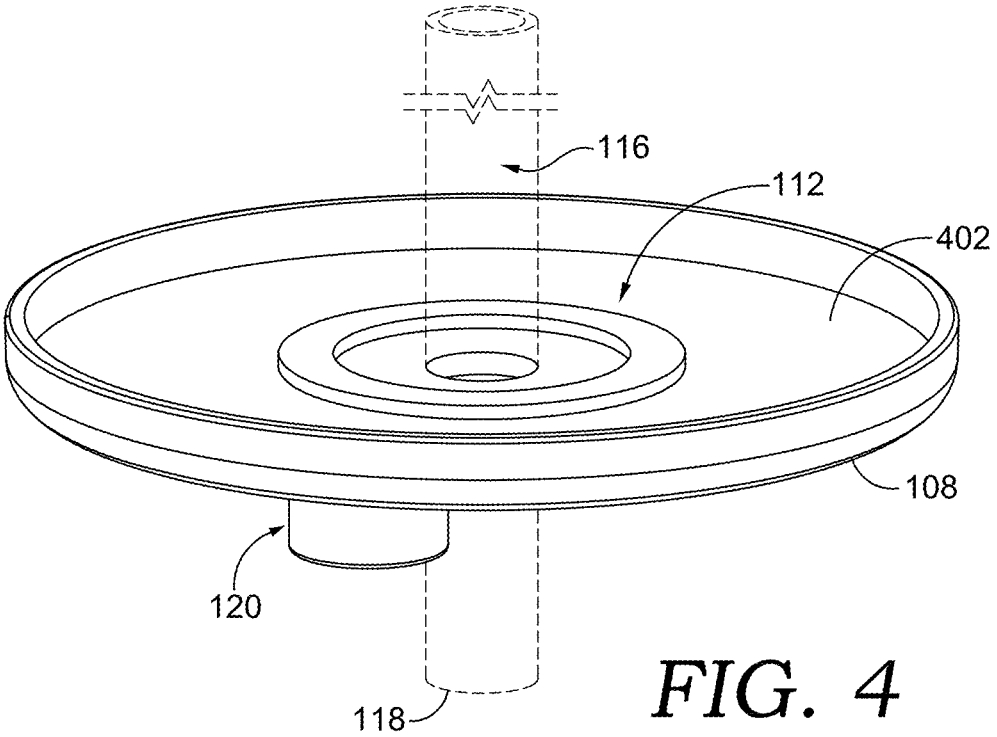
FIG. 4 depicts a perspective view of an exemplary beverage container lid adapted for use with the removable straw cover securing mechanism, in accordance with some embodiments hereof.
Figure 5:
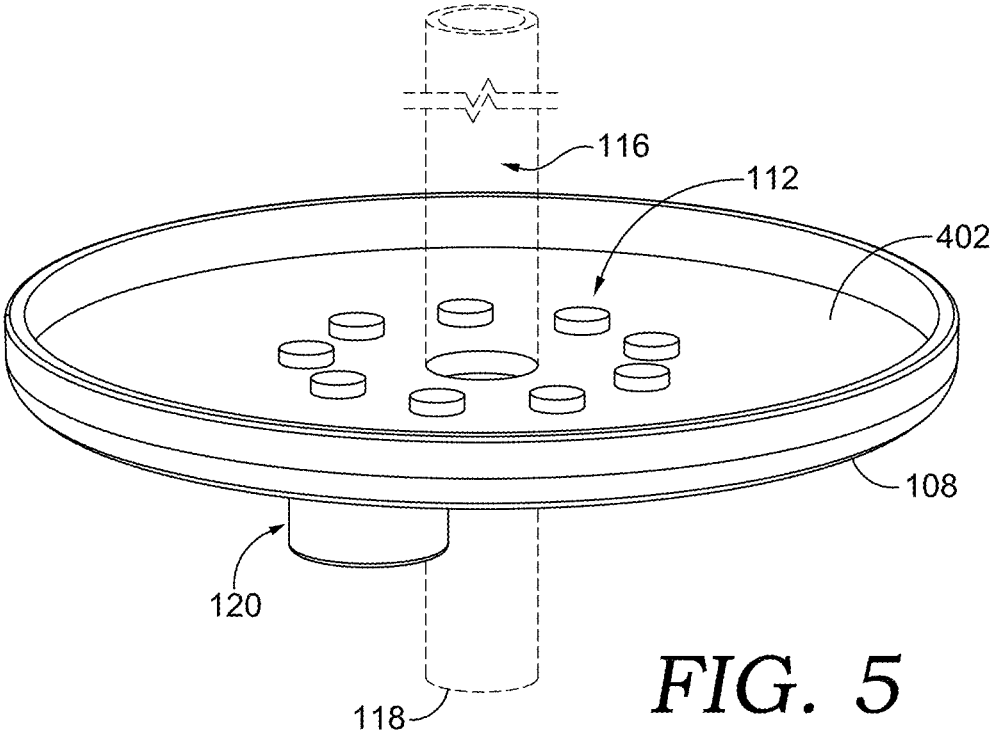
FIG. 5 depicts a perspective view of an exemplary beverage container lid adapted for use with the removable straw cover securing mechanism, in accordance with some other embodiments hereof.

Looking now at FIGS. 4 and 5, a top layer of the lid 102 is shown in an upside-down state. The lid 102 comprises a top surface 108 and a bottom surface 402. The removable straw cover 120 is in a "stow" configuration and is still firmly attached to the top surface 108 of the lid 102. The lid 102 comprises one or more of a magnetic element (e.g., neodymium) or a ferromagnetic element, or the lid 102 itself, including the bottom surface 402, may be magnetic. The removable straw cover 120 also comprises one or more of a magnetic or ferromagnetic element. As discussed above in the definitions section, there are three types of potential magnetic interactions between the removable straw cover 120 and the lid 102. In one configuration, the neodymium magnet 210 in the removable straw cover 120 can couple with a ferromagnetic lid 102, such as one made of iron, nickel, cobalt, steel, or the like, creating a strong magnetic connection. This attraction provides a reliable hold, although generally not as strong as a magnet-to-magnet connection. Alternatively, the removable straw cover 120 may contain a ferromagnetic material, and the lid 102 could contain the neodymium magnet, achieving the desired coupling with the magnetic force coming from the lid. A third option is to have neodymium magnets in both the removable straw cover 120 and the lid 102, resulting in the strongest possible magnetic interaction, ensuring the removable straw cover 120 stays firmly attached to the lid 102 until intentionally removed. Additionally, magnets may be of opposite polarity in the removable straw cover 120 and the lid 102, which helps secure the removable straw cover 120 to the lid 102. The magnetic components in the removable straw cover 120 and lid 102 are designed to releasably couple with each other, providing a secure yet easily detachable connection. The ease of detachment remains a key feature, allowing users to effortlessly remove the straw cover 120 when desired while simultaneously ensuring the removable straw cover 120 stays in place on the lid 102 when desired.

Looking now to FIG. 4, one or more magnetically attractive elements 112 within the lid 102 are configured as a magnetic ring, embedded around a central opening of the lid 102, to ensure secure attachment of the removable straw cover 120 in multiple orientations, in accordance with some embodiments of the present disclosure. Alternatively, shown in FIG. 5, the one or more magnetically attractive elements 112 within the lid 102 comprise one or more individual magnetic elements.

In at least some embodiments herein, the magnetic or ferromagnetic material in the lid 102 can be distributed throughout the entire lid 102. This design allows for a uniform magnetic field across the lid's 102 surface, ensuring a strong and consistent attachment to the removable straw cover 120 regardless of how the lid 102 is positioned. In other embodiments, the magnetic or ferromagnetic material can be localized to a specific spot on the lid 102. This focused placement can provide targeted magnetic coupling with the corresponding element on the removable straw cover 120. By concentrating the magnetic force in one area, the lid 102 can achieve a strong connection with the removable straw cover 120 while potentially reducing the amount of magnetic or ferromagnetic material required. This design also allows for more flexibility in the lid's overall structure and can be beneficial for aesthetic or ergonomic considerations.

In accordance with embodiments herein, the magnetic or ferromagnetic material can be integrally formed within the inner surface of the removable straw cover 120. To state it differently, in some embodiments, the inner surface and the magnetic or ferromagnetic material can be formed, e.g., through the associated manufacturing process (e.g., molding, vacuum or injection molding, 3D printing, etc.), to be a continuous surface without clear or delineated junctions between distinct materials, such that there is a smooth transition across the adjacent surfaces. In embodiments, the lid 102 can comprise a recess or an indentation on the top surface to receive the removable straw cover 120, providing a designated storage location for the removable straw cover 120 and enhancing the magnetic engagement. A removable straw cover (e.g., removable straw cover 120) manufactured using the above processes may help facilitate smooth engagement with the straw 116. In some embodiments, the outer surface of the lid 102 is comprised of non-magnetic material, and the one or more magnetically attractive elements 112 are embedded within an interior layer of the lid to maintain a smooth external surface. In some embodiments, the removable straw cover 120 can be sized, shaped, and adapted to have a friction fit with the straw 116. This frictional resistance can help with retaining the removable straw cover 120 on the straw 116, and in addition help maintain the seal that is formed through engagement of the removable straw cover securing mechanism.

In addition to the example of FIGS. 1-5, the removable straw cover securing mechanisms described herein can be incorporated into portable beverage containers (e.g., insulated and non-insulated), as well as other cans, cups, bowls, canisters, flasks, thermoses, containers, or other enclosures used to store liquids where selectively maintaining a substantially liquid-impermeable barrier at an opening is desired.

Embodiment 1. A removable straw cover for a drinking straw, comprising: a body configured to fit snugly over an open end of the drinking straw, the body having a first end and a second end, wherein the first end includes a sealing surface adapted to engage with the outer surface of the drinking straw to create a fluid-tight seal; a closure portion at the second end of the body adapted to fully cover the open end of the drinking straw, thereby preventing spillage of liquid from the drinking straw when not in use; and a magnetic element disposed within the removable straw cover against an inside of the closure portion at the second end, the magnet being adapted to magnetically attach the removable straw cover to a magnetically attractive element disposed on or within a beverage container or a lid of the beverage container in which the drinking straw is used.

Embodiment 2. The removable straw cover of embodiment 1, wherein the body comprises a flexible, resilient material that allows repeated attachment and detachment from the straw without loss of sealing integrity.

Embodiment 3. The removable straw cover of embodiment 2, wherein the flexible, resilient material includes silicone, rubber, or a thermoplastic elastomer.

Embodiment 4. The removable straw cover of any of embodiments 1-3, wherein the magnetic element is a neodymium magnet to provide a strong magnetic attachment to the magnetically attractive element on or within the beverage container or lid thereof.

Embodiment 5. The removable straw cover of any of embodiments 1-4, wherein the magnetic element is encased within a protective enclosure integrated into the closure portion to prevent contact with liquid and protect the magnet from corrosion.

Embodiment 6. The removable straw cover of any of embodiments 1-5, wherein the sealing surface of the first end includes one or more circumferential ribs or grooves adapted to enhance the fluid-tight seal between the removable straw cover and the drinking straw.

Embodiment 7. The removable straw cover of any of embodiments 1-6, further comprising a grip portion integrated into the body to facilitate manual attachment and detachment of the removable straw cover from the drinking straw.

Embodiment 8. The removable straw cover of any of embodiments 1-7, wherein the grip portion comprises one or more raised ridges, textured surfaces, or tabs to improve the user's grip during attachment and detachment.

Embodiment 9. A removable straw cover for a drinking straw, comprising: a body configured to fit snugly over an open end of the drinking straw, the body having a first end and a second end, wherein the first end includes a sealing surface adapted to engage with the outer surface of the drinking straw to create a fluid-tight seal; a closure portion at the second end of the body adapted to fully cover the open end of the drinking straw, thereby preventing spillage of liquid from the drinking straw when not in use; and a magnetically attractive element disposed within the removable straw cover against an inside of the closure portion at the second end, the magnetically attractive element being adapted to magnetically attach the removable straw cover to another magnetically attractive element disposed on or within a beverage container or a lid of the beverage container in which the drinking straw is used.

Embodiment 10. The removable straw cover of embodiment 9, wherein the magnetically attractive element is a magnet.

Embodiment 11. The removable straw cover of any of embodiments 9-10, wherein the other magnetically attractive element is a ferromagnetic surface.

Embodiment 12. The removable straw cover of any of embodiments 9-10, wherein the other magnetically attractive element is another magnet.

Embodiment 13. The removable straw cover of any of embodiments 9-12, wherein the magnetically attractive element is a ferromagnetic surface.

Embodiment 14. The removable straw cover of any of embodiments 9-13, wherein the other magnetically attractive element is a magnet.

Embodiment 15. A beverage container system, comprising: a removable straw cover for a drinking straw, the removable straw cover comprising: a body configured to fit over an open end of the drinking straw, the body having a first end and a second end, wherein the first end includes a sealing surface adapted to engage with the outer surface of the drinking straw to create a fluid-tight seal; a closure portion at the second end of the body adapted to fully cover the open end of the drinking straw, thereby preventing spillage of liquid from the drinking straw when not in use; a magnetically attractive element disposed within the removable straw cover against an inside of the closure portion at the second end; a lid for a beverage container, the lid comprising: a top surface adapted to cover an opening of the beverage container; one or more magnetically attractive elements embedded within or disposed under the top surface of the lid, the one or more magnetically attractive elements being adapted to magnetically engage with the magnetically attractive element of the removable straw cover, thereby allowing the removable straw cover to be stowed on the lid when the removable straw cover is not in use.

Embodiment 16. The beverage container system of embodiment 15, wherein the one or more magnetically attractive elements within the lid are configured as a magnetic ring, embedded around a central opening of the lid, to ensure secure attachment of the removable straw cover in multiple orientations.

Embodiment 17. The beverage container system of any of embodiments 15-16, wherein the one or more magnetically attractive elements within the lid comprises a magnetic ring.

Embodiment 18. The beverage container system of any of embodiments 15-17, wherein the lid further comprises a recess or an indentation on the top surface to receive the removable straw cover, providing a designated storage location for the removable straw cover and enhancing the magnetic engagement.

Embodiment 19. The beverage container system of any of embodiments 15-18, wherein the lid is comprised of a non-magnetic material, and the one or more magnetically attractive elements are embedded within an interior layer of the lid to maintain a smooth external surface.

Embodiment 20. The beverage container system of any of embodiments 15-19, further comprising a straw adapted to extend through or couple with an opening in the lid.

In some aspects, this disclosure may include the language, for example, "at least one of [element A] and [element B]." This language may refer to one or more of the elements. For example, "at least one of A and B" may refer to "A," "B," or "A and B." In other words, "at least one of A and B" may refer to "at least one of A and at least one of B," or "at least either of A or B." In some aspects, this disclosure may include the language, for example, "[element A], [element B], and/or [element C]." This language may refer to either of the elements or any combination thereof. In other words, "A, B, and/or C" may refer to "A," "B," "C," "A and B," "A and C," "B and C," or "A, B, and C." In addition, this disclosure may use the term "and/or" which may refer to any one or combination of the associated elements. In addition, this disclosure may use the term "a" (element) or "the" (element). This language may refer to the referenced element in the singular or in the plural and is not intended to be limiting in this respect.

The subject matter of this disclosure has been described in relation to particular aspects, which are intended in all respects to be illustrative rather than restrictive. In this sense, alternative aspects will become apparent to those of ordinary skill in the art to which the present subject matter pertains without departing from the scope hereof. In addition, different combinations and sub-combinations of elements disclosed, as well as use and inclusion of elements not shown, are possible and contemplated as well.

What is claimed is:

1. A cover for a beverage container opening, comprising:

a body configured to selectively cover the opening to inhibit ingress or egress of liquid, the opening being associated with a beverage conduit extending from the beverage container; and at least one magnetically attractive element disposed on, in, around, or integral with the body, the body being configured to magnetically couple to a magnetically attractive element associated with the beverage container when the body is not covering the opening.

2. The cover of claim 1, wherein the beverage conduit comprises a straw or another structure associated with the opening of the beverage container.

3. The cover of claim 1, wherein the magnetically attractive element is positioned externally on the body.

4. The cover of claim 1, wherein the magnetically attractive element is visible when the cover is in use.

5. The cover of claim 1, wherein the magnetically attractive element is embedded beneath a protective layer of the body.

6. The cover of claim 1, wherein the magnetically attractive element is selected from: a permanent magnet, a ferromagnetic material, or a combination thereof.

7. The cover of claim 1, wherein the magnetically attractive element comprises a neodymium magnet.

8. The cover of claim 1, wherein the body has a non-cylindrical shape.

9. The cover of claim 1, wherein the body has a stepped, contoured, or decorative profile.

10. The cover of claim 1, wherein the body is configured for frictional engagement with the beverage conduit.

11. The cover of claim 1, wherein the body comprises a flexible, resilient material including silicone, rubber, or a thermoplastic elastomer.

12. The cover of claim 1, wherein the magnetically attractive element is disposed at or near a closure portion of the body.

13. The cover of claim 1, wherein the magnetically attractive element is disposed adjacent to an open end of the body opposite the closure portion.

14. The cover of claim 1, wherein the magnetically attractive elements of the cover and the beverage container form a magnet-to-magnet interaction.

15. The cover of claim 1, wherein the magnetically attractive elements of the cover and the beverage container form a magnet-to-ferromagnet interaction.

16. The cover of claim 1, wherein the body includes a grip portion comprising raised ridges, textured surfaces, or tabs to assist manual attachment and removal.

17. The cover of claim 1, wherein the body and the magnetically attractive element are integrally formed.

18. The cover of claim 1, wherein the magnetically attractive element is ornamental in appearance.

19. The cover of claim 1, wherein the magnetically attractive element associated with the beverage container is positioned on or within the beverage container in a location to magnetically couple to the cover when the cover is not covering the opening.

* * * * *